United States Patent [19]

Young

[11] 4,155,501

[45] May 22, 1979

[54] PARTITION STRUCTURE

[75] Inventor: Harry E. Young, Houston, Tex.

[73] Assignee: Container Corporation of America, Chicago, Ill.

[21] Appl. No.: 935,146

[22] Filed: Aug. 21, 1978

[51] Int. Cl.[2] ..... B65D 5/48; B65D 25/04

[52] U.S. Cl. ..... 229/15

[58] Field of Search ..... 229/15, 24, 27, 28

[56] References Cited

U.S. PATENT DOCUMENTS

| | | | |
|---|---|---|---|
| 2,899,122 | 8/1959 | Schaefer | 229/42 X |
| 3,258,189 | 6/1966 | Graser | 229/15 |
| 3,478,947 | 11/1969 | Schillinger | 229/15 |
| 3,640,445 | 2/1972 | Durham | 229/15 |
| 4,108,348 | 8/1978 | Partain | 229/15 |

*Primary Examiner*—Davis T. Moorhead

*Attorney, Agent, or Firm*—Carpenter & Ostis

[57] ABSTRACT

A one piece paperboard internal partition structure including a longitudinal wall and at least one transverse wall foldably joined thereto.

7 Claims, 2 Drawing Figures

PARTITION STRUCTURE

SUMMARY OF THE INVENTION

This invention relates to partition arrangements and more particularly to an internal partition structure formed of paperboard and adapted to form a plurality of cells within an outer container or wrapper.

It is an object of the invention to provide a one piece structure which adapts itself to quick assembly and which is self locking.

A more specific object of the invention is the provision of a one piece paperboard internal partition structure which includes a longitudinal wall and at least one transverse wall foldably joined to the longitudinal wall by gusset means and having a pair of panel portions disposed on opposite sides of the longitudinal wall.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 2:
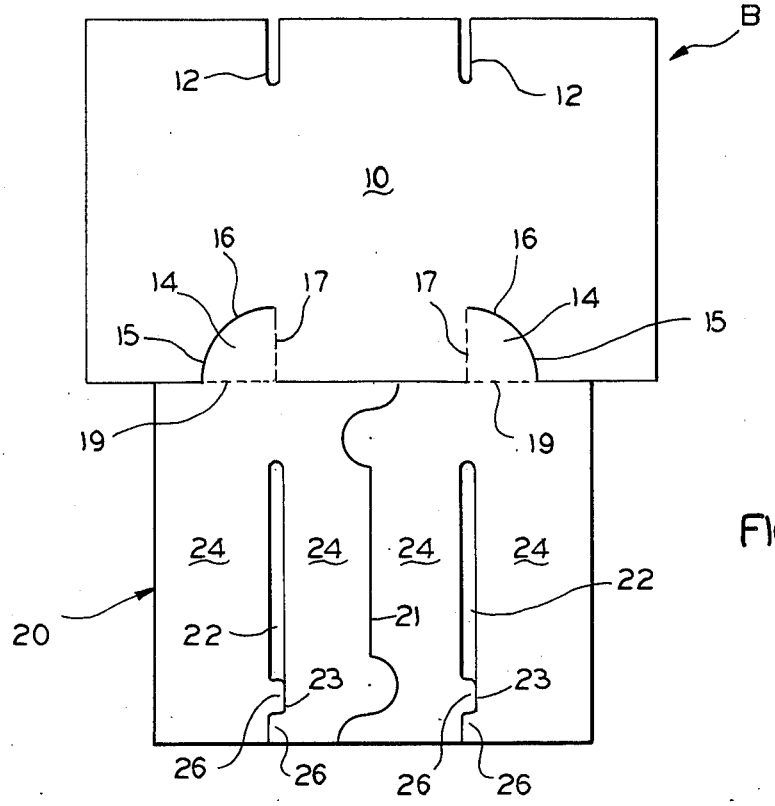
FIG. 2 is a plan view of a blank of foldable sheet material from which the partition structure illustrated in FIG. 1 may be formed.
Figure 1:
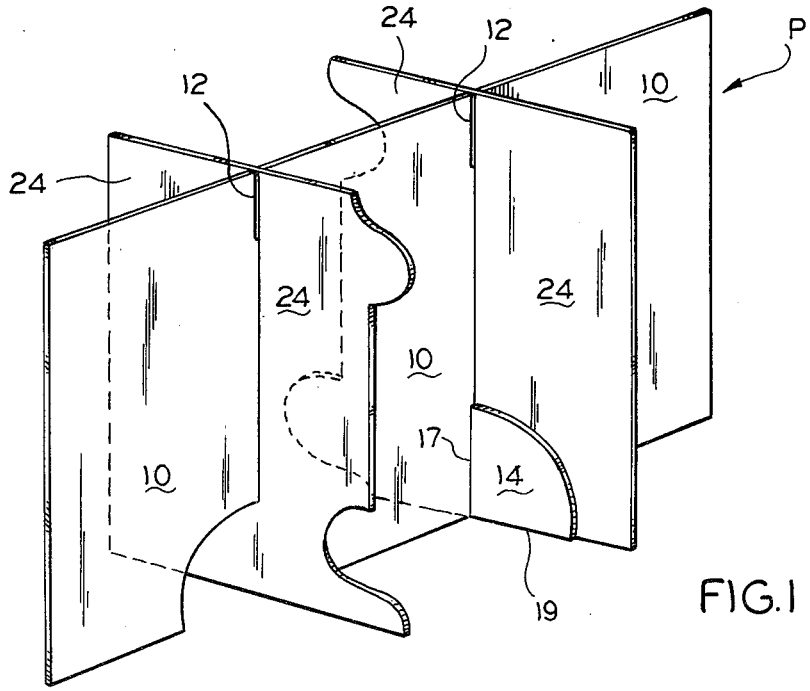
FIG. 1 is a perspective view of a partition structure embodying features of the invention as shown in the erected condition.

Referring now to the drawings for a better understanding of the invention, it will be seen that a novel, one piece internal partition structure indicated generally at P in FIG. 1 may be formed from a unitary blank B of foldable sheet material, such as paperboard, illustrated in FIG. 2.

The partition structure P includes a preferably rectangular, vertically disposed, longitudinal panel indicated generally at 10 having one or more vertically disposed transverse panels 20 foldably joined thereto in a manner hereinafter described. In the embodiment of the invention illustrated in the drawings, there are provided two transverse panels 20 which, together with longitudinal panel 10, form six cells. Obviously, without departing from the basic concept of the invention, a similar structure could easily be provided which would afford four cells, eight cells, or any desired number of cells, depending upon the number of transverse partitions employed.

As best seen in FIG. 2, longitudinal panel 10 is provided at its upper end with a pair of longitudinally spaced slots or openings 12 which preferably extend vertically downwardly from the upper edge of panel 10.

Adjacent its lower edge, panel 10 is provided with a pair of generally pie shaped gussets 14 which are formed from material of longitudinal panel 10 and which are each defined by a preferably arcuate cut line 15 and a pair of diverging fold lines 17 and 19 which extend normal to each other with fold line 17 joining gusset 14 to panel 10 and with fold line 19 which is co-extensive with the lower edge of panel 10, joining gusset 14 to transverse panel 20.

Although in the embodiment of the invention illustrated in the drawings, gussets 14 are formed from the material of panel 10, the arrangement may be reversed with the gussets being formed from materials of panels 20.

Still referring to FIG. 2, it will be seen that there are provided a pair of adjacent transverse panels 20 formed in blank B and separated from each other by a cut line 21.

Each of the transverse panels 20 contains a slot 22 extending vertically for a substantial portion of panel 20, and a slit 23 which extends from the upper end of slot 22 to the upper edge of panel 20. Thus it will be seen that slot 20 and slit 23 serve to divide panel 20 into a pair of similar panel sections 24 which are integral with each other at the lower end of panel 20. Slit 23 is offset to provide a pair of locking tabs 26 in the upper ends of panel sections 24.

In erecting the structure, each of the panels 20 is folded 90° about fold line 17 into a position normal with longitudinal panel 10 and is then folded upwardly 180° about fold line 19 so that, when erected, the slot 22 receives portions of longitudinal panel 10 with each of the panel sections being disposed on opposite sides of longitudinal panel and with the locking tabs 26 being received within related opening 12 at the upper edge of panel 10.

Thus it will be understood that the invention provides a unique one piece partition arrangement of simple design and construction which may be readily erected manually and is entirely self locking.

I claim:

1. An internal partition, formed from a unitary blank of foldable paperboard, for forming a plurality of cells within an outer wrapper or container, comprising:

(a) a vertically disposed longitudinal panel having at least one opening therein located adjacent one horizontal edge thereof;

(b) at least one vertically disposed transverse panel having a first horizontal edge foldably joined along a main fold line to another horizontal edge of said longitudinal partition which is remote from said one horizontal edge, and being divided into two panel sections by a slot extending vertically for a substantial portion of its height and a slit extending from one end of said slot to a second horizontal edge of said transverse panel which is remote from said first horizontal edge;

(c) each of said panel sections including a lock tab formed by said slit.

(d) one of said panels including a gusset formed from material of said one panel and being defined by a cut line and a pair of angularly related, diverging fold lines on which said gusset is foldably joined to respective panels;

(e) said gusset being located adjacent said main fold line and permitting said transverse panel to be folded normal to said longitudinal panel with a portion of said longitudinal panel being received in said transverse panel slot, and with said transverse panel sections being disposed on opposite sides of said longitudinal panel, and with said lock tabs of the former being received within said opening of the latter.

2. An internal partition, formed from a unitary blank of foldable paperboard, for forming a plurality of cells within an outer wrapper or container, comprising:

(a) a vertically disposed longitudinal panel having at least one horizontal edge;

(b) at least one vertically disposed transverse panel having a first horizontal edge foldably joined along a main fold line to another horizontal edge of said longitudinal partition which is remote from said one horizontal edge, and being divided into two panel sections by a slot extending vertically for a substantial portion of its height;

(c) one of said panels including a gusset formed from material of said one panel and being defined by a cut line and a pair of angularly related, diverging fold lines on which said gusset is foldably joined to respective panels;

(d) said gusset being located adjacent said main fold line and permitting said transverse panel to be folded normal to said longitudinal panel with a portion of said longitudinal panel being received in said transverse panel slot, and with said transverse panel sections being disposed on opposite sides of said longitudinal panel.

3. A partition according to claim 1, wherein said opening comprises a slot extending downwardly from said one horizontal edge of said longitudinal panel.

4. A partition according to claim 1, wherein said slit is offset to form adjacent lock tabs in respective panel sections.

5. A partition according to claim 1, wherein said gusset is formed from material of said longitudinal panel.

6. A partition according to claim 1, wherein said main fold line is located adjacent the lower horizontal edges of said longitudinal and transverse panels.

7. A partition according to claim 2, wherein said panel sections have lock tabs projecting therefrom which are received within an opening in said longitudinal panel to provide interlocking relation between said panels.

* * * * *